US011940221B2

(12) United States Patent
Dunn

(10) Patent No.: US 11,940,221 B2
(45) Date of Patent: Mar. 26, 2024

(54) MULTI-STACKED HEAT EXCHANGER

(71) Applicant: Dandelion Energy, Inc., New York, NY (US)

(72) Inventor: John Dunn, New York, NY (US)

(73) Assignee: DANDELION ENERGY, INC., Palo Alto, CA (US)

( * ) Notice: Subject to any disclaimer, the term of this patent is extended or adjusted under 35 U.S.C. 154(b) by 0 days.

(21) Appl. No.: 17/852,061

(22) Filed: Jun. 28, 2022

(65) Prior Publication Data

US 2023/0272978 A1 Aug. 31, 2023

Related U.S. Application Data

(60) Provisional application No. 63/314,959, filed on Feb. 28, 2022.

(51) Int. Cl.

| | |
|---|---|
| ***F28D 1/053*** | (2006.01) |
| ***F25B 30/02*** | (2006.01) |
| ***F28D 1/04*** | (2006.01) |
| ***F28D 21/00*** | (2006.01) |

(52) U.S. Cl.

CPC ..... *F28D 1/05391* (2013.01); *F25B 30/02* (2013.01); *F28D 1/0417* (2013.01); *F28D 21/00* (2013.01); *F25B 2400/07* (2013.01); *F28D 2021/0068* (2013.01)

(58) Field of Classification Search

CPC ..... F25B 31/006; F25B 39/00; F25B 30/02; F25B 2400/07; F28D 1/053; F28D 1/0435; F28D 1/0452; F28D 1/05391; F28D 1/0417; F28D 21/00; F28D 2021/0068; F28F 1/022

See application file for complete search history.

(56) References Cited

U.S. PATENT DOCUMENTS

| | | | | |
|---|---|---|---|---|
| 10,670,344 | B2 * | 6/2020 | Ito | F24F 13/30 |
| 2019/0285348 | A1 * | 9/2019 | Snider | F28D 21/00 |
| 2020/0033033 | A1 * | 1/2020 | Yoshioka | F28D 1/0471 |

* cited by examiner

*Primary Examiner* — Len Tran
*Assistant Examiner* — Kamran Tavakoldavani
(74) *Attorney, Agent, or Firm* — Fountainhead Law Group P.C.

(57) ABSTRACT

A multi-stacked heat exchanger comprises a first heat exchanger and a second heat exchanger. A first end of the first heat exchanger receives a first fluid in a first conduit flowing in a first direction within a plane. A first end of the second heat exchanger receives the first fluid from the first heat exchanger in a second direction flowing opposite to the first direction within the plane. A flow of a second fluid is communicated through the second heat exchanger and then through the first heat exchanger, in a second direction orthogonal to the first direction. The second fluid is in thermal communication with the first fluid in the second heat exchanger and then in the first heat exchanger. By doubling the flowed first fluid back upon itself, embodiments achieve counterflow between the first fluid and second fluid within a compact space.

20 Claims, 12 Drawing Sheets

MULTI-STACKED HEAT EXCHANGER

CROSS REFERENCE TO RELATED APPLICATION

This application claims the benefit of priority to U.S. Provisional Patent Application No. 63/314,959, filed Feb. 28, 2022, the entire contents of which are incorporated herein by reference.

BACKGROUND

Heat pumps may be used to provide temperature control to a space. This is achieved by removing or adding heat to and from the space, and rejecting or sourcing heat from the area outside of the temperature controlled space.

DRAWINGS

The present disclosure will become more fully understood from the detailed description and the accompanying drawings, wherein.

Figure 6:
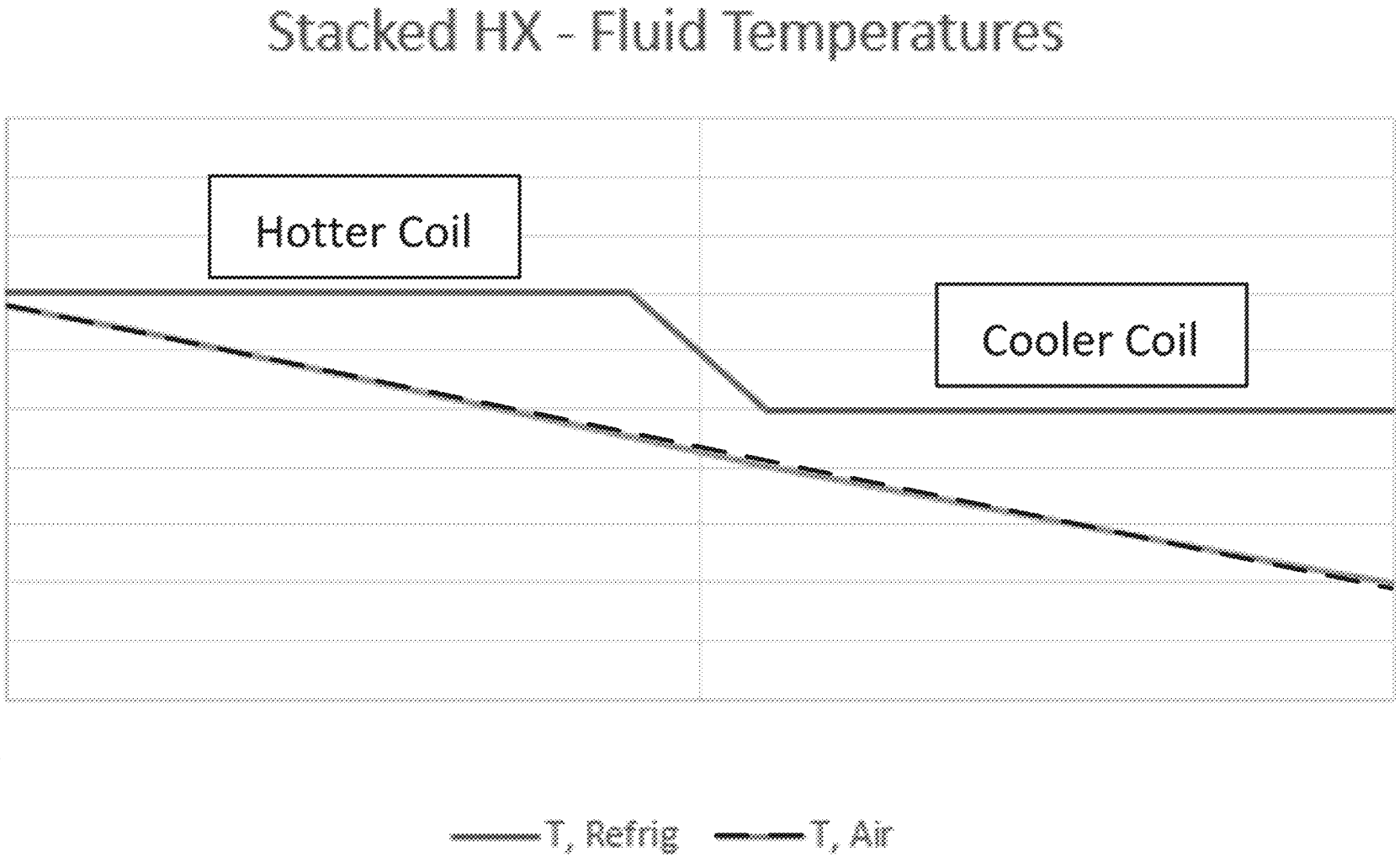

FIG. 6 plots fluid temperature versus location for a stacked arrangement.

Figure 6A:
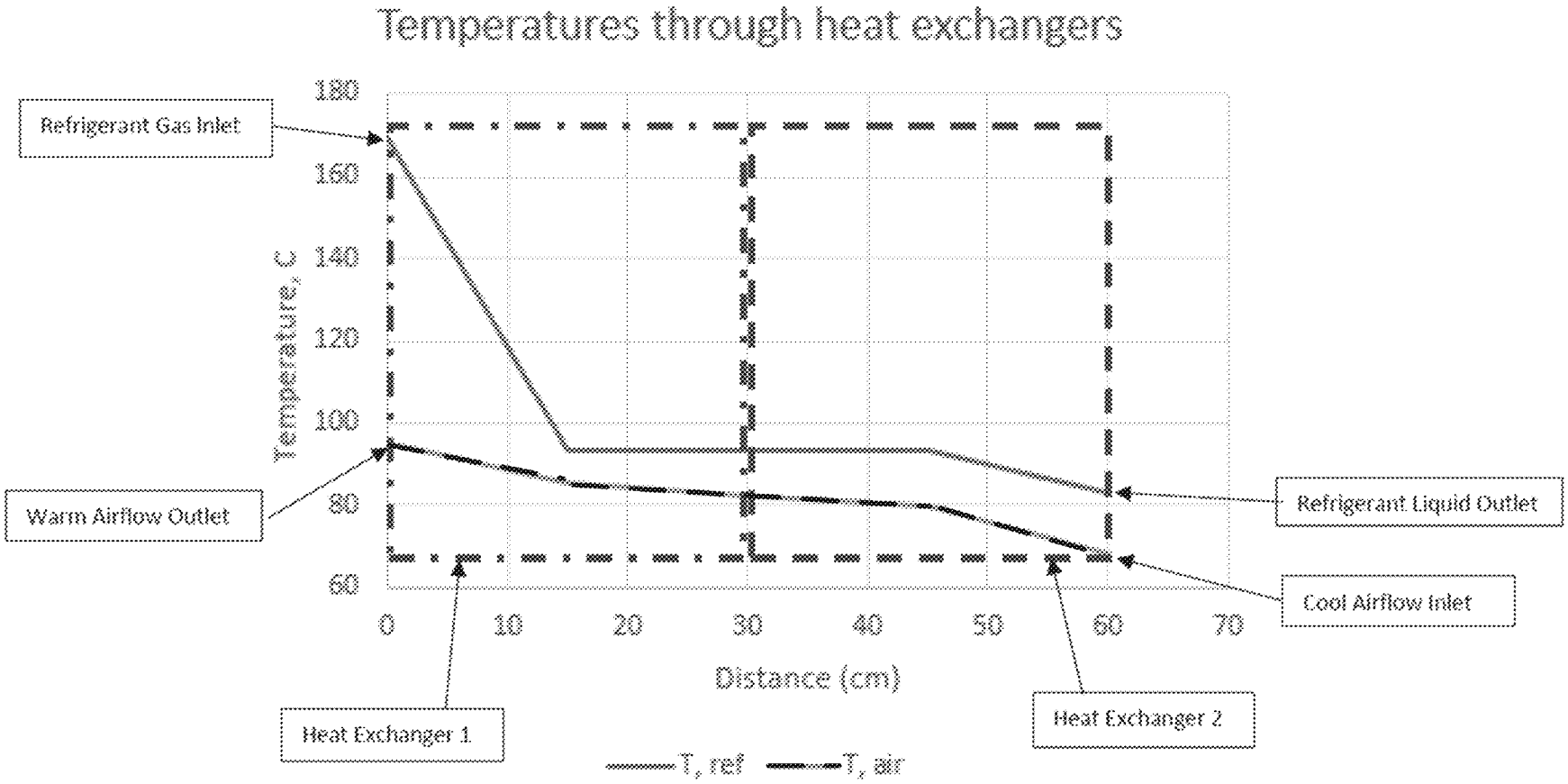

FIG. 6A is a more detailed plot of fluid temperature versus location for a stacked arrangement.

Figure 7:
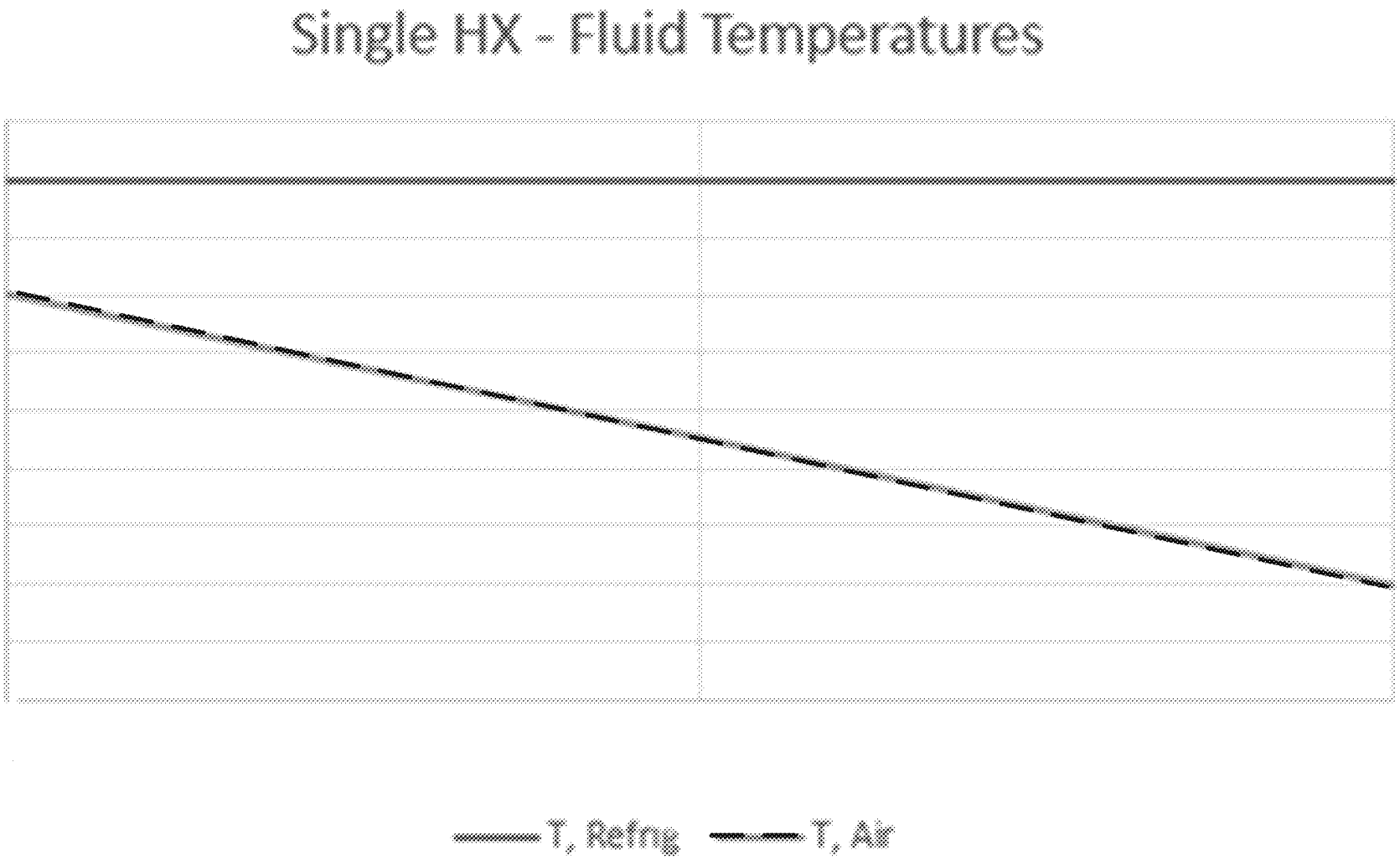

FIG. 7 plots temperature versus location for a single coil arrangement.

Figure 7A:
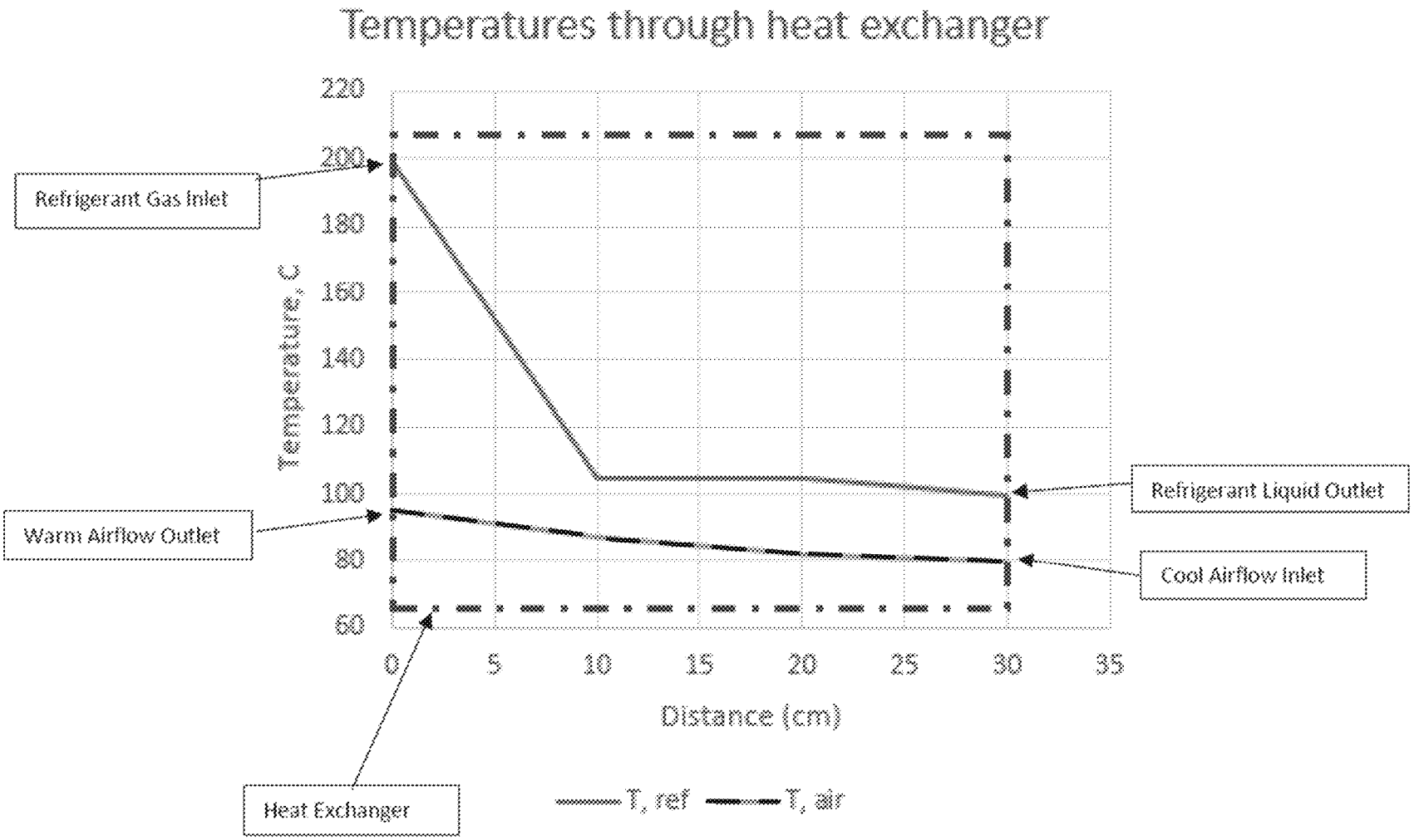

FIG. 7A is a more detailed plot of fluid temperature versus location for a single coil arrangement.

DISCLOSURE

In the following description, for purposes of explanation, numerous examples and specific details are set forth in order to provide a thorough understanding of the present disclosure. Such examples and details are not to be construed as unduly limiting the elements of the claims or the claimed subject matter as a whole. It will be evident to one skilled in the art, based on the language of the different claims, that the claimed subject matter may include some or all of the features in these examples, alone or in combination, and may further include modifications and equivalents of the features and techniques described herein.

Features and benefits of the present disclosure include techniques for providing a heat exchanger for use with a heat pump. A ground source heat pump is example of a heat pump that is used to keep the interior space at a comfortable temperature. A ground source heat pump uses the ground as the outside space where heat is sourced or rejected.

Figure 1:
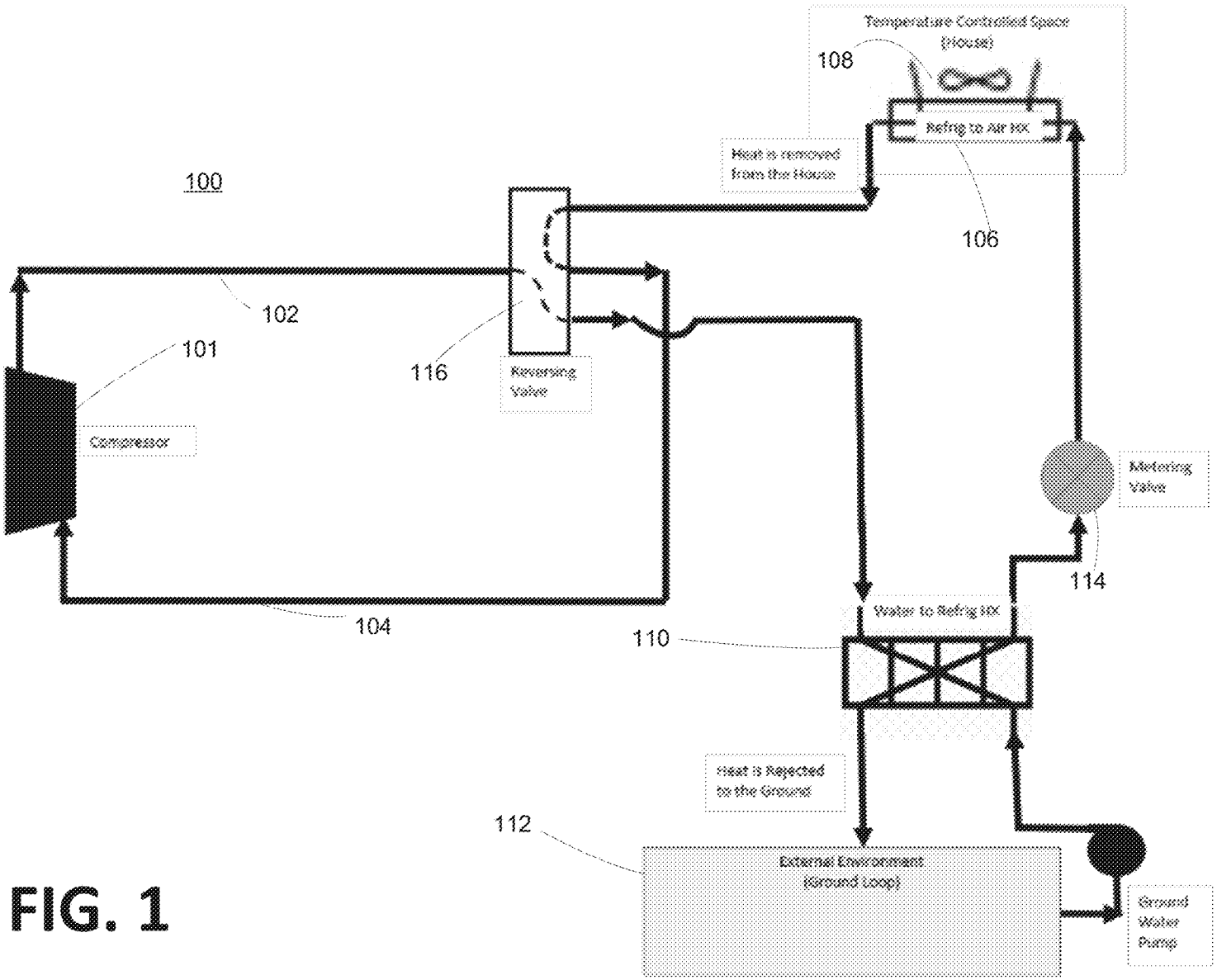
FIG. 1 shows a simplified view of a ground source heat pump in a cooling mode of operation.
Figure 2:
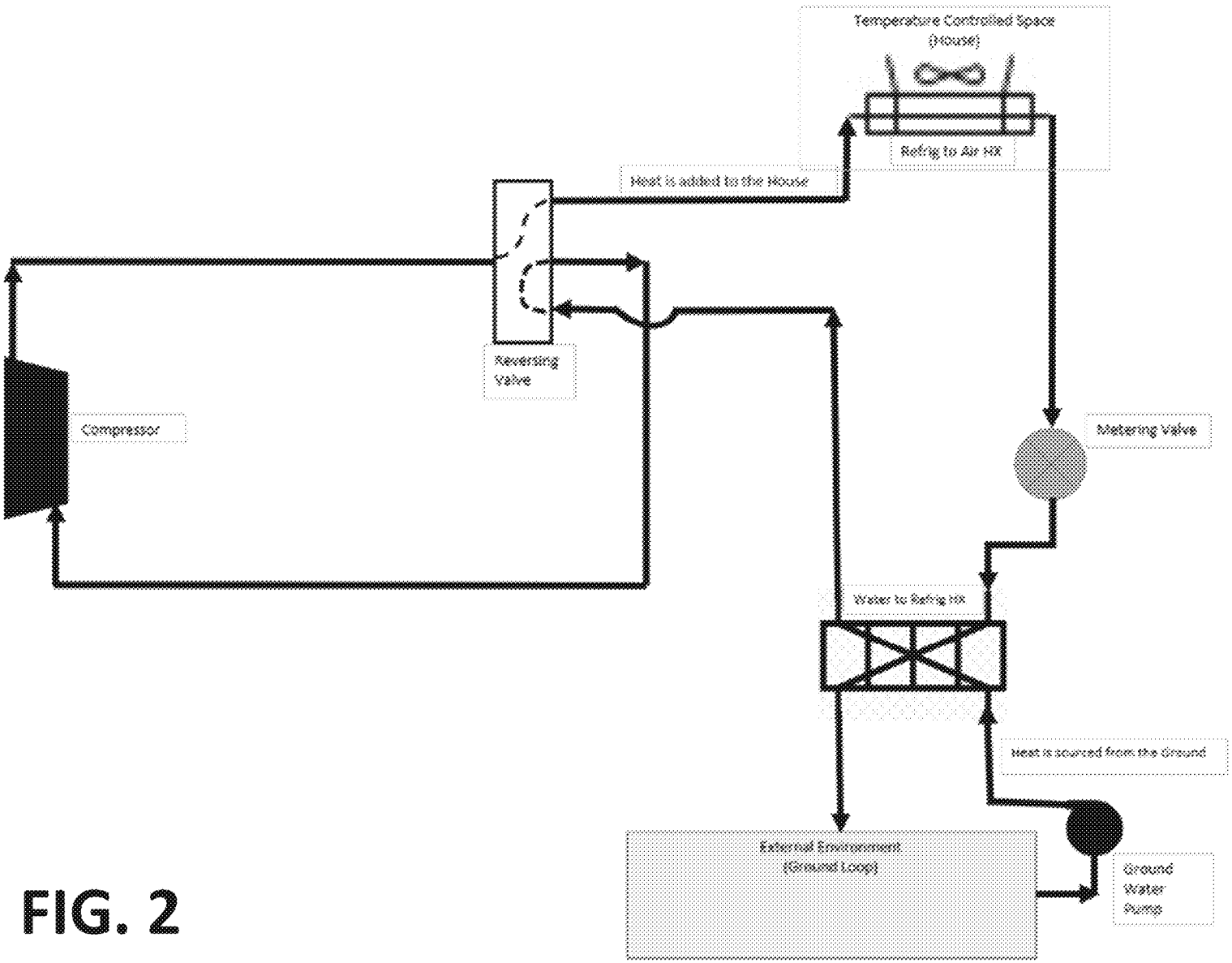
FIG. 2 shows a simplified view of a ground source heat pump in a heating mode of operation.

FIG. 1 shows a simplified view of a ground source heat pump 100 in a cooling mode of operation. FIG. 2 shows a simplified view of a ground source heat pump in a heating mode of operation.

A heat pump may comprise the following five (5) elements.

1) A compressor 101 that moves working fluid (refrigerant) 102 through a circuit 104.
2) A primary side heat exchanger 106 that exchanges heat with the controlled temperature space 108.
3) A secondary side heat exchanger 110 that sources/sinks heat into the space 112 outside of the temperature controlled space.
4) A metering valve 114 which regulates the flow of refrigerant through the circuit.
5) A reversing valve 116 which changes the flow direction of refrigerant, allowing the circuit to extract or add heat to the temperature controlled space.

FIGS. 1-2 show a ground source heat pump, where the space outside of the temperature controlled space is the ground. However, other types of heat pumps are possible, for example air-source heat pumps where the space outside of the temperature controlled space is the air of the surrounding environment.

Figure 3:
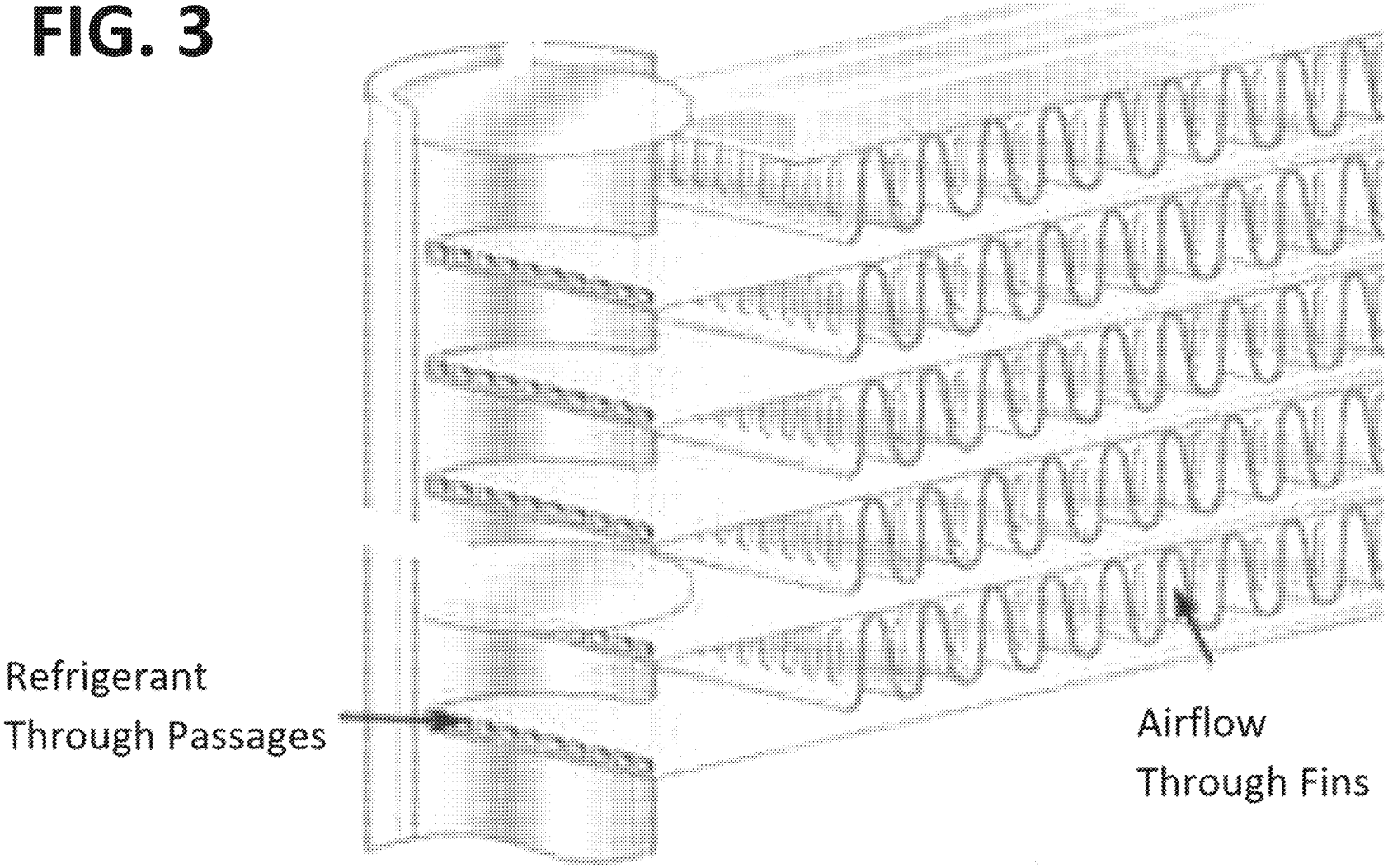
FIG. 3 shows a simplified cross-sectional view of a heat exchanger.

FIG. 3 shows a simplified cross-sectional view of a heat exchanger. For the primary side heat exchanger, an air-to-refrigerant coil may be used to exchange heat with the interior temperature controlled space.

Such heat exchangers may comprise multiple tubes for passage of refrigerant flow on the interior of the exchanger. The tubes may be coupled to aluminum or copper fin material, which are effectively cooled or heated by the refrigerant flowing in the tubes.

Airflow is passed through the fins, and picks up heat or rejects heat as it passes over the fins. This airflow is then recirculated to and from the temperature controlled space in order to add or remove heat, depending on the mode of operation.

Furthermore, the refrigerant in the coil is changing phase as it rejects or absorbs heat from the air. For cooling operation, the refrigerant is evaporating from a liquid to a gas. For heating, the refrigerant is condensing from a gas to a liquid.

During such phase transition, refrigerant temperature is constant and is a function of pressure. So, the temperature at which the phase change is happening may determine the operating pressures of the compressor and therefore performance.

For heat transfer to take place, a temperature difference is present, as described in the following equation.

$Q=U*A*dT$, where

Q=heat—(Watts or Btu/hr)

U=heat transfer coefficient

A=Surface area of the exchanger dT=Temperature difference between the refrigerant and the air.

Thermodynamic principles determine operating temperatures and efficiencies achievable by heat pumps and air conditioners. Operating temperatures are controlled by operating limits of the compressor. Efficiency of the system is affected by the temperature differences achievable by the heat exchangers as they determine compressor operating pressures.

Air exchangers may be deployed in a stacked approach that reduces the temperature differential between refrigerant and the exiting air temperature. Such an arrangement allows systems to reach higher and/or lower temperatures. Stacked air exchangers can also increase system efficiency over the entire range, by reducing pressures from the compressor.

In a stacked arrangement according to an embodiment, airflow is passed through multiple refrigerant to air exchangers. The refrigerant and airflow are in counterflow to each other.

For heating, the hot refrigerant goes into the 1st exchanger and passes to the next ($2^{nd}$) exchanger. As the refrigerant travels through each heat exchanger, the refrigerant loses heat to the air.

The refrigerant in the 1st exchanger contains hot discharge gas in addition to the condensing refrigerant. The 2nd exchanger has condensing refrigerant plus some subcooled liquid refrigerant. Thus, the 1st exchanger has a hotter average temperature than the 2nd exchanger.

For the airflow, the cooler airflow to be heated is introduced into the $2^{nd}$ (coolest) heat exchanger. As the air is warmed by the $2^{nd}$ heat exchanger, it then passes through the $1^{st}$ (hottest) exchanger, picking up more heat.

In such a manner, because the refrigerant flow is effectively opposite the airflow (i.e., passing through heat exchanger 2 before heat exchanger 1), the flow between the refrigerant and the airflow is in counterflow. This orientation of flows between the two fluids maximizes the temperature difference (dT) through the entire flow path of both fluids. This in turn maximizes heat transfer (Q).

Figure 4:
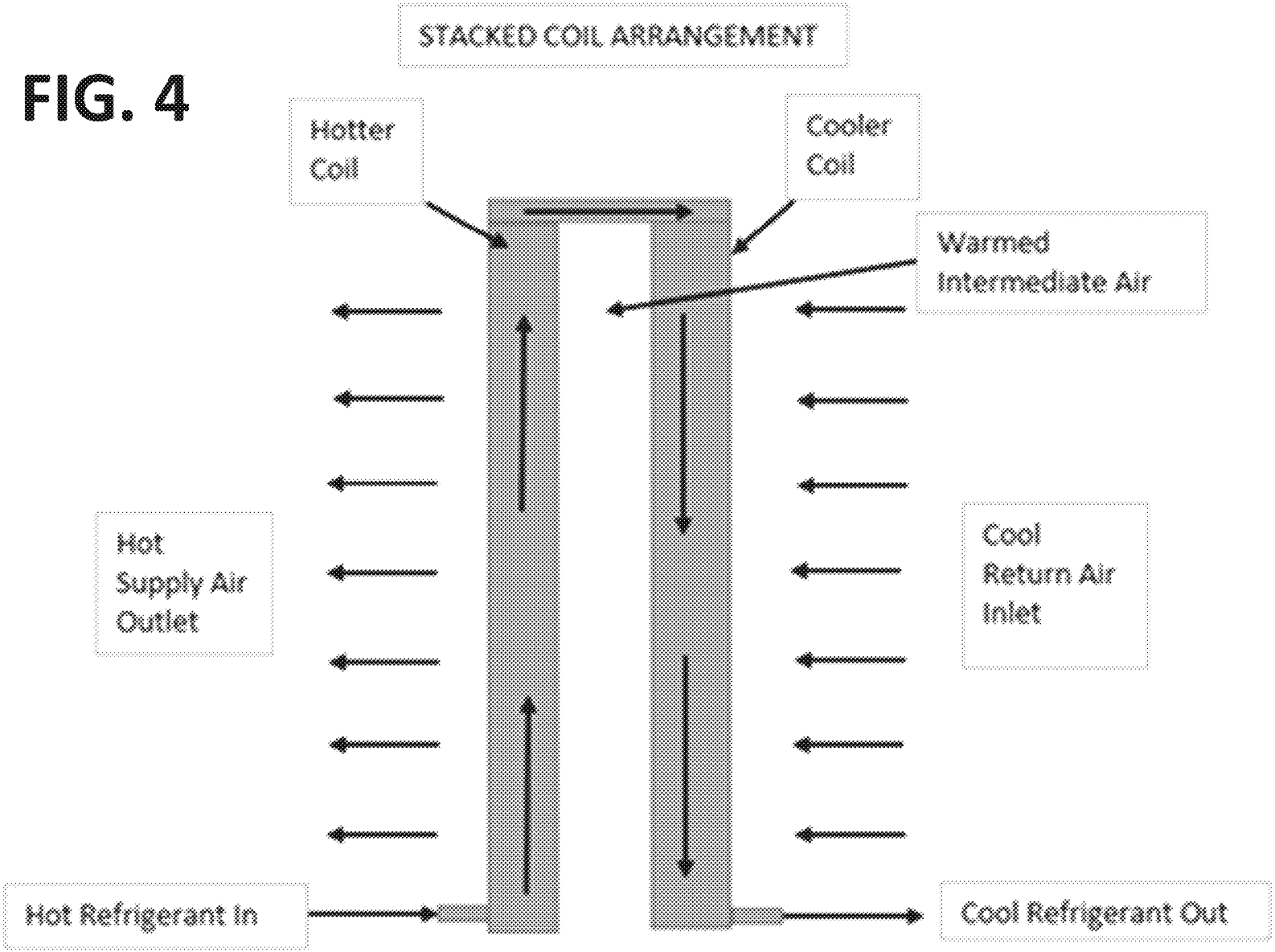
FIG. 4 shows a simplified side view of a stacked arrangement.
Figure 4A:
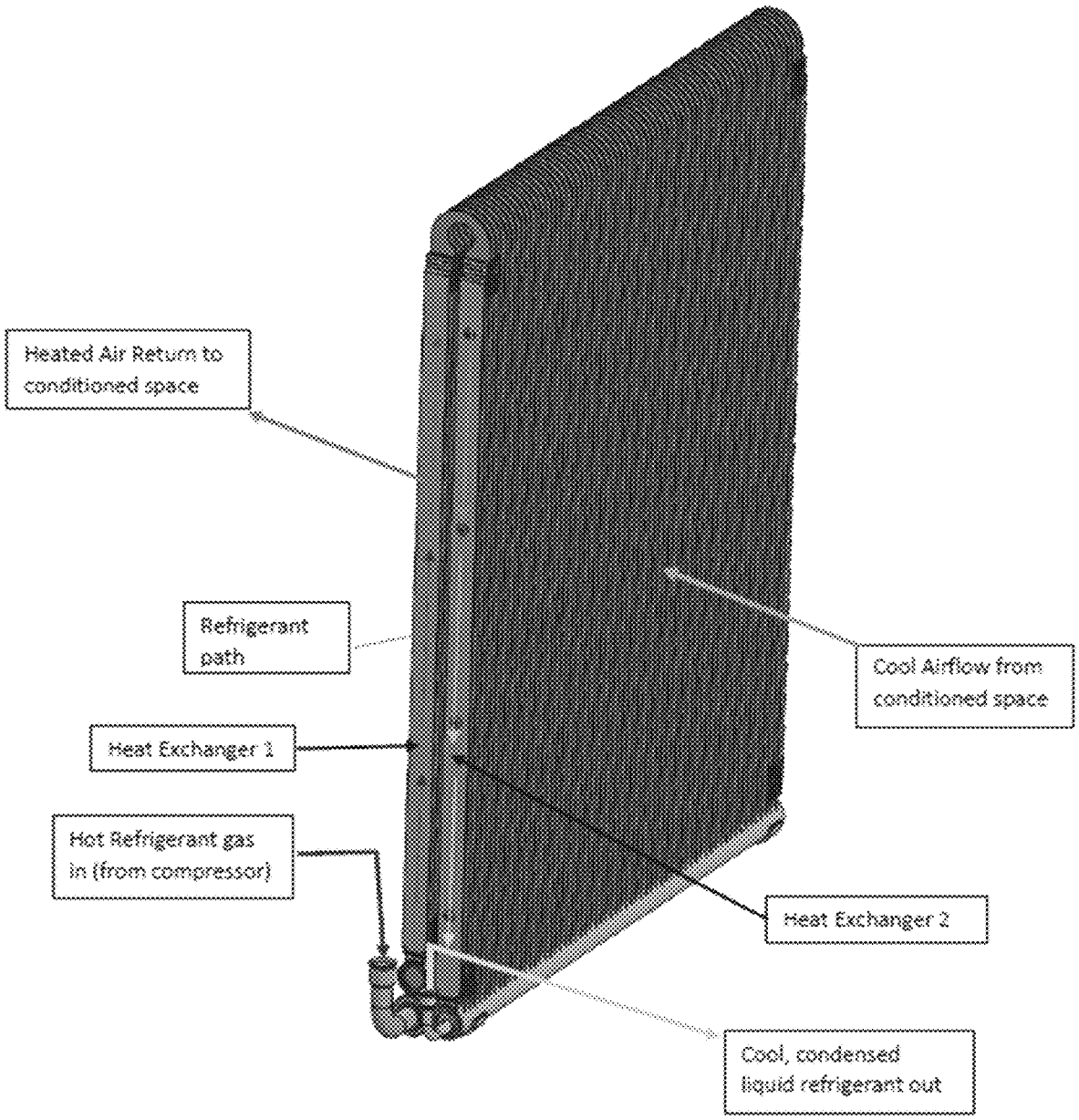
FIG. 4A shows a simplified perspective view of a stacked arrangement.

FIG. 4 shows a simplified view of a stacked arrangement. FIG. 4A shows a simplified perspective view of a stacked arrangement.

Figure 4C:
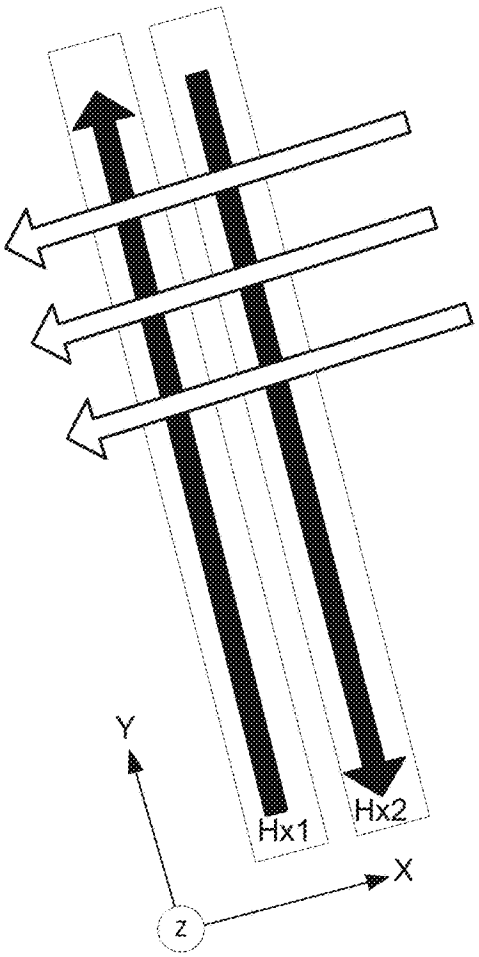
FIG. 4C shows a simplified planar view of a stacked embodiment.
Figure 4B:
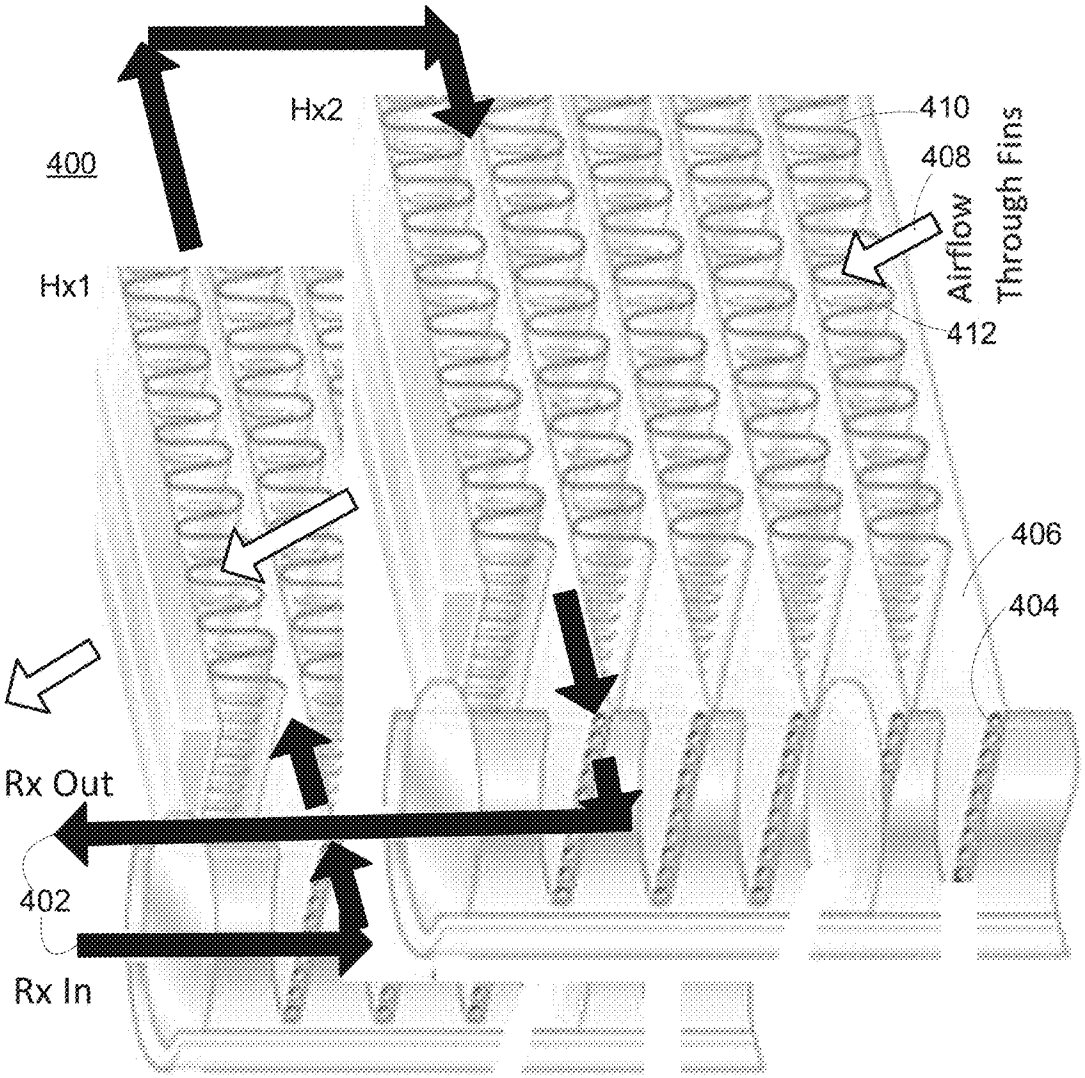
FIG. 4B shows a simplified exploded perspective view of a stacked arrangement.

FIG. 4B shows a simplified exploded view 400 of a stacked arrangement. In particular, this view shows the reversed direction of flow 402 of refrigerant through the parallel conduits 404 present within the plates 406. FIG. 4B also shows the one-way direction of flow 408 of air through the passages 410 defined by the fins 412 supporting the plates/conduits.

FIG. 4C shows a simplified planar view of a stacked arrangement.

Specifically, as the refrigerant flow is effectively opposite the airflow—which passes through heat exchanger 2 (Hx2) before heat exchanger 1 (Hx1)—the flow between the refrigerant and the airflow is in counterflow.

Figure 5:
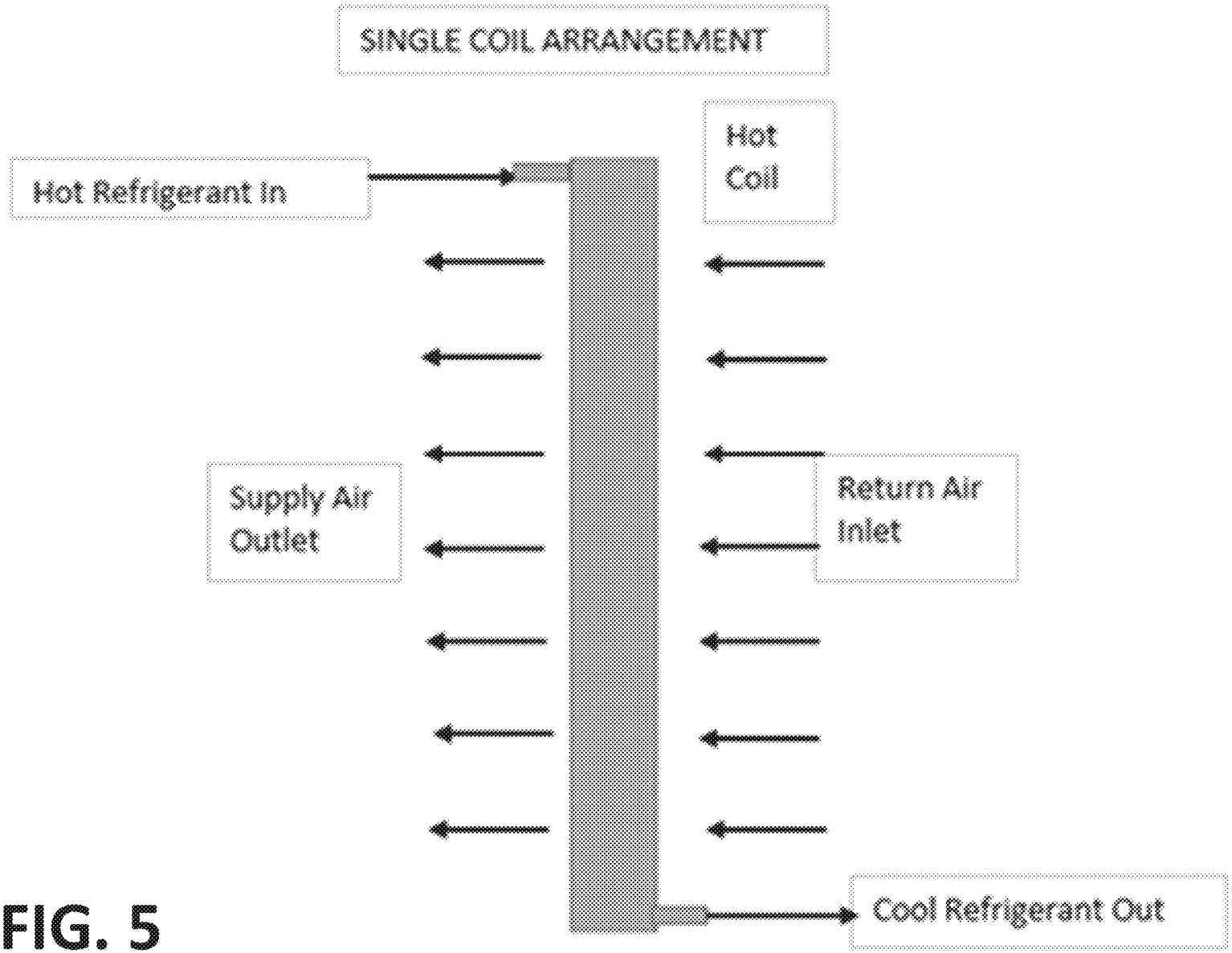
FIG. 5 shows a simplified side view of a single coil arrangement.
Figure 5A:
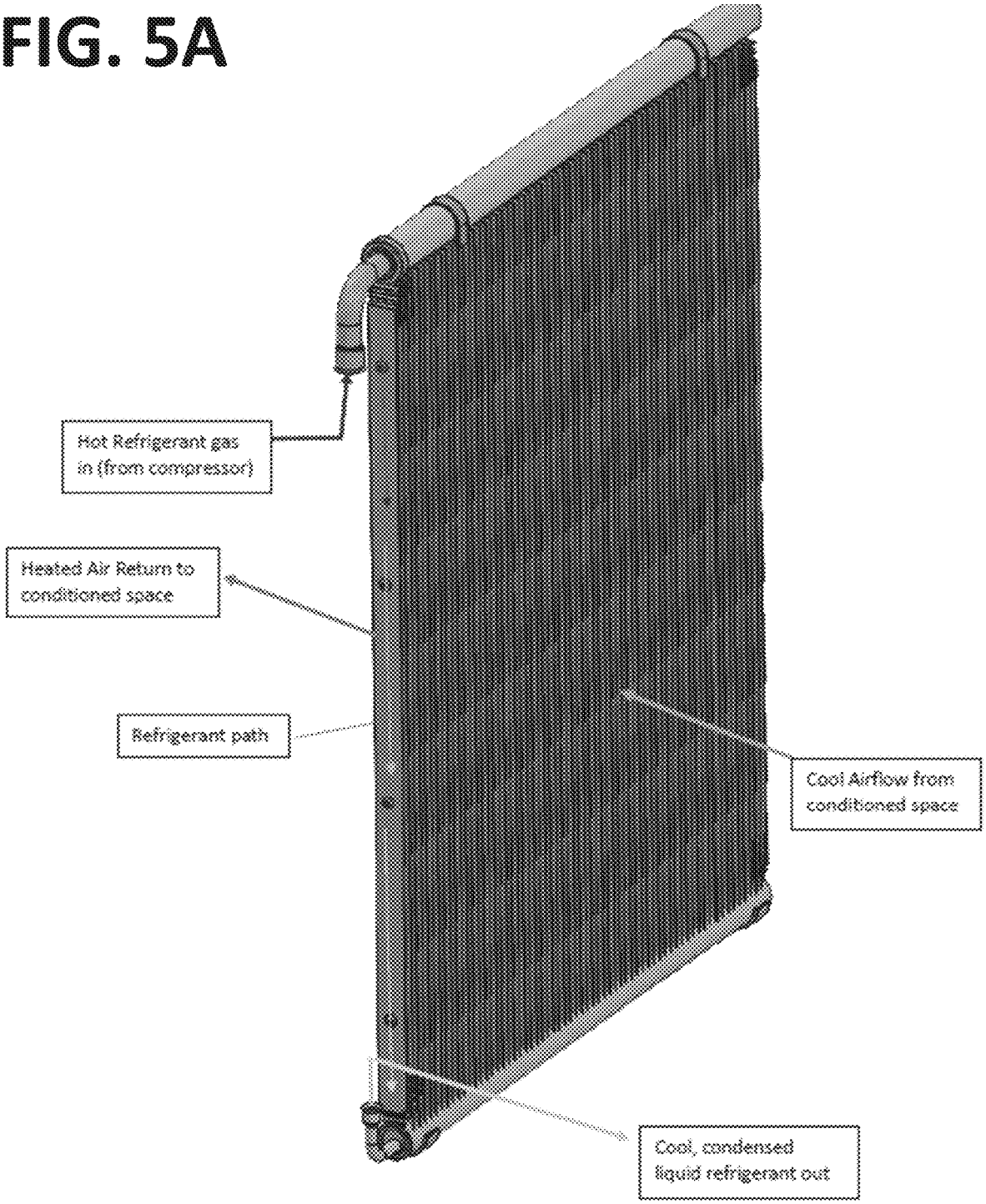
FIG. 5A shows a simplified perspective view of a single coil arrangement.

FIG. 5 shows a simplified view of a single coil arrangement. FIG. 5A shows a simplified perspective view of a single coil arrangement.

In the single-coil arrangement, both the refrigerant and the airflow pass through a single heat exchanger. In such an arrangement the temperature difference (dT) between the refrigerant and the airflow is larger.

For a given conditioned air space temperature, this results in the pressure delivered by the compressor being larger. Accordingly, such a single coil system is less efficient and less able to reach higher air temperatures.

FIG. 6 plots fluid temperature versus location for a stacked arrangement.

FIG. 6A is a more detailed plot of fluid temperature versus location for a stacked arrangement.

FIG. 7 plots temperature versus location for a single coil arrangement.

FIG. 7A is a more detailed plot of fluid temperature versus location for a single coil arrangement.

One benefit of a stacked arrangement is that temperature differentials are preserved in each individual heat exchanger. This reduces the temperature difference between the refrigerant temperature and the leaving air temperature.

As described herein, embodiments may achieve one or more of:

1) creating a more efficient heat exchanger for refrigerant to air applications, minimizing the temperature differential needed for heat transfer;
2) allowing for the heat pump to reach higher and/or lower temperatures; and
3) increasing the heat pump thermal efficiency over points of the operating ranges.

The above description illustrates various embodiments of the present disclosure along with examples of how aspects of the particular embodiments may be implemented. The above examples should not be deemed to be the only embodiments, and are presented to illustrate the flexibility and advantages of the particular embodiments as defined by the following claims. Based on the above disclosure and the following claims, other arrangements, embodiments, implementations and equivalents may be employed without departing from the scope of the present disclosure as defined by the claims.

What is claimed is:

1. An apparatus comprising:

a first heat exchanger defining, a first conduit configured to receive a first fluid at a first end, flow the first fluid in a first direction through the first heat exchanger, and output the first fluid at a second end, and a first passage configured to communicate a flow of a second fluid in a second direction orthogonal to the first direction, the flow of the first fluid in thermal communication with the flow of the second fluid; and a second heat exchanger in fluid communication with the first heat exchanger and defining, a second conduit configured to receive the first fluid from the second end of the first conduit, flow the first fluid in a third direction opposite and parallel to the first direction through the second heat exchanger, and output the first fluid at a second end, a second passage configured to communicate the flow of the second fluid in the second direction, the flow of the second fluid in thermal communication with the flow of the second fluid, wherein the flow of the second fluid passes through the second passage prior to the first passage, in counterflow with the flow of the first fluid, wherein the first heat exchanger defines a first planar surface and the second heat exchanger defines a second planar surface substantially the same size as the first planar surface, wherein the first planar surface is parallel to and offset from the second planar surface, and wherein the first fluid flows over the first and second planar surfaces, in counterflow, to transfer thermal energy with the second fluid across substantially all of the first and second planar surfaces.

2. The apparatus as in claim 1 wherein the first fluid comprises a refrigerant.

3. The apparatus as in claim 1 wherein the second fluid comprises air.

4. The apparatus as in claim 1 wherein the first heat exchanger and the second heat exchanger are separated by a gap.

5. The apparatus as in claim 4 wherein the gap comprises air.

6. The apparatus as in claim 1 wherein:

the first passage is defined between a first set of fins in thermal communication with the first fluid; and the second passage is defined between a second set of fins in thermal communication with the first fluid.

7. The apparatus as in claim 6 wherein:

the first set of fins support the first conduit; and the second set of fins support the second conduit.

8. The apparatus as in claim 1 wherein:

the first end of the first heat exchanger is configured to be in fluid communication with a compressor output to receive the first fluid as a hot gas; and the second end of the second heat exchanger is configured to produce the first fluid as a condensed liquid in fluid communication with the compressor input.

9. The apparatus as in claim 8 wherein the compressor is part of a heat pump.

10. The apparatus as in claim 1 wherein:

the first fluid flow through a first plurality of tubes in the first direction in the plane of the first heat exchanger, the first fluid flow through a second plurality of tubes in the third direction in the plane of the second heat exchanger, and wherein the first plurality of tubes is coupled to the second plurality of tubes along a full length of the first and second heat exchangers.

11. A method comprising:

receiving at a first end of a first heat exchanger, a first fluid in a first conduit flowing in a first direction;

receiving at a first end of a second heat exchanger, the first fluid in a second direction flowing opposite to the first direction; and receiving a flow of a second fluid, through the second heat exchanger, and then through the first heat exchanger, in a third direction orthogonal to the first direction and second direction, the second fluid in thermal communication with the first fluid, wherein the first heat exchanger defines a first planar surface and the second heat exchanger defines a second planar surface substantially the same size as the first planar surface, wherein the first planar surface is parallel to and offset from the second planar surface, and wherein the first fluid flows over the first and second planar surfaces, in counterflow, to transfer thermal energy with the second fluid across substantially all of the first and second planar surfaces.

12. The method as in claim 11 wherein the first fluid comprises a refrigerant.

13. The method as in claim 11 wherein the second fluid comprises air.

14. The method as in claim 11 wherein the first heat exchanger and the second heat exchanger are separated by a gap.

15. The method as in claim 14 wherein the gap comprises air.

16. A method as in claim 11 wherein:

the first passage is defined between a first set of fins in thermal communication with the first fluid; and the second passage is defined between a second set of fins in thermal communication with the first fluid.

17. The method as in claim 16 wherein:

the first set of fins support the first conduit; and the second set of fins support the second conduit.

18. The method as in claim 11 wherein:

the first end of the first heat exchanger receiving the first fluid as a hot gas from a compressor output; and the second end of the second heat exchanger producing the first fluid as a condensed liquid to a compressor input.

19. The method as in claim 18 wherein the compressor is part of a heat pump.

20. The method as in claim 19 wherein the heat pump comprises a ground source heat pump.

* * * * *